United States Patent [19]

Hoeft

[11] 4,292,583

[45] Sep. 29, 1981

[54] VOLTAGE AND TEMPERATURE STABILIZED CONSTANT CURRENT SOURCE CIRCUIT

[75] Inventor: Werner H. Hoeft, Santa Clara County, Calif.

[73] Assignee: Signetics Corporation, Sunnyvale, Calif.

[21] Appl. No.: 117,118

[22] Filed: Jan. 31, 1980

[51] Int. Cl.[3] ..... G05F 1/56

[52] U.S. Cl. ..... 323/316; 323/303

[58] Field of Search ..... 323/1, 4, 8

[56] References Cited

U.S. PATENT DOCUMENTS

| | | | |
|---|---|---|---|
| 3,714,543 | 1/1973 | Sahara et al. | 323/9 |
| 3,886,435 | 5/1975 | Steckler | 323/4 |
| 3,962,592 | 6/1976 | Thommen et al. | 323/4 |
| 3,979,663 | 9/1976 | Herchner | 323/4 |
| 4,100,477 | 7/1978 | Tam | 323/8 |

OTHER PUBLICATIONS

IBM Technical Disclosure Bulletin, vol. 12, No. 11, Apr. 1970.

IBM Technical Disclosure Bulletin, vol. 19, No. 11, Apr. 1977.

*Primary Examiner*—William H. Beha, Jr.

*Attorney, Agent, or Firm*—Thomas A. Briody; Robert T. Mayer; Steven R. Biren

[57] ABSTRACT

A constant current source circuit includes a single differential amplifier having both voltage and temperature stabilization circuits. The voltage and temperature stabilization circuits operate on a feedback principle, each receiving an input from the differential amplifier, and each in turn providing a signal back to the differential amplifier to provide the desired stabilization. The resulting circuit is particularly adapted for use in battery-powered equipment, where substantial variations in both temperature and operating voltage are likely to occur.

8 Claims, 1 Drawing Figure

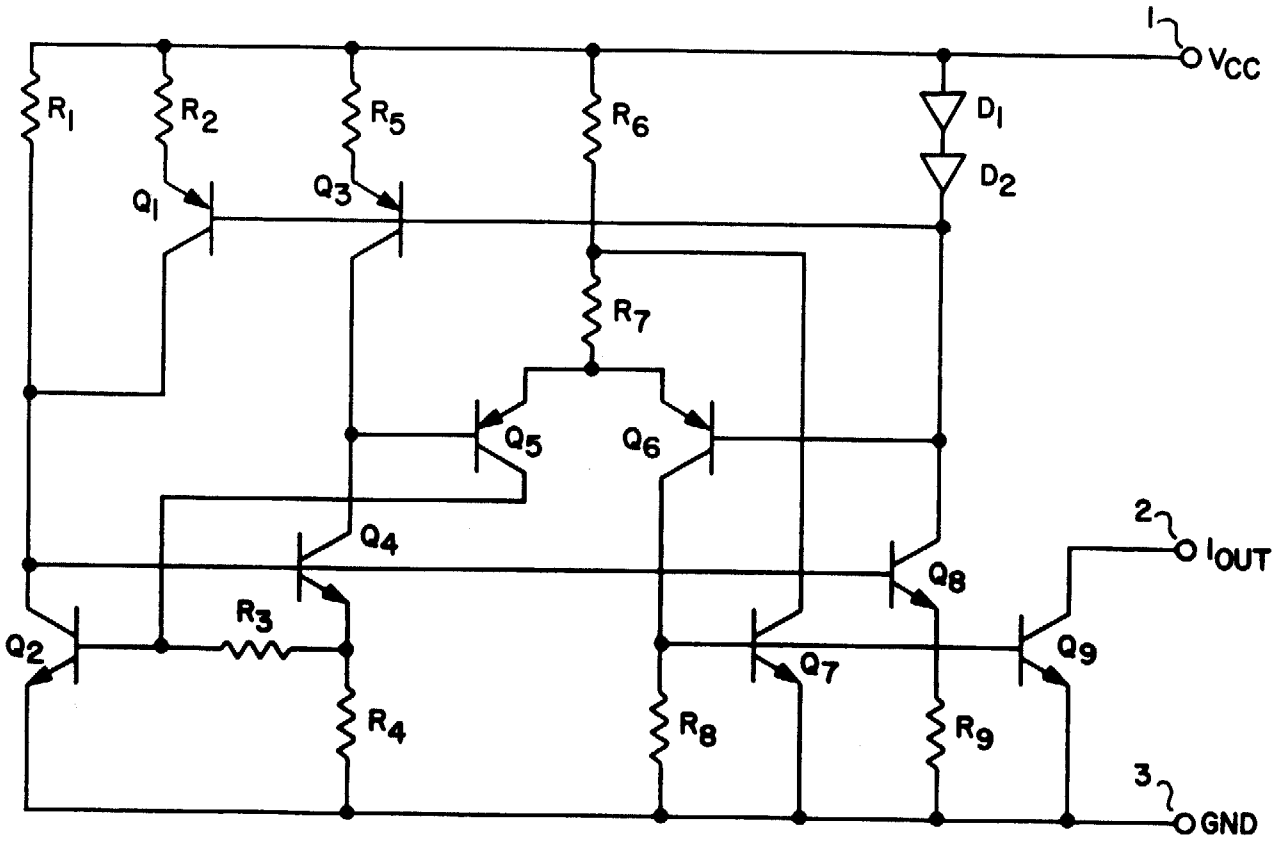
1
VCC
D1
D2
R6
R7
R5
Q3
R2
Q1
R1
Q6
Q5
Q4
R3
Q2
2
IOUT
Q9
Q8
R9
Q7
R8
R4
3
GND

VOLTAGE AND TEMPERATURE STABILIZED CONSTANT CURRENT SOURCE CIRCUIT

BACKGROUND OF THE INVENTION

This invention is in the field of constant current source circuits, and relates specifically to a constant current source circuit having both voltage and temperature stabilization.

Typical prior art constant current source circuits are shown in U.S. Pat. Nos. 3,714,543, 3,886,435 and 3,962,592. These patents are directed to constant current source circuit arrangements which additionally provide some form of temperature compensation, in order to stabilize output current as a function of temperature. However, these prior art circuits do not provide a high degree of stabilization with respect to power supply voltage variations, and are thus not ideally suitable for operation in battery-powered equipment for use in other applications where substantial variations in both ambient temperature and operating voltage are likely to be encountered.

SUMMARY OF THE INVENTION

An object of the invention is to provide a constant current source circuit having an output current which is stabilized with respect to both power supply voltage and temperature variations.

A further object of the invention is to provide a voltage and temperature stabilized constant current source circuit which is both simple in construction and efficient in operation.

In accordance with the invention, these objects are accomplished by a new constant current source circuit using a single differential amplifier in combination with both voltage and temperature stabilization circuits. The differential amplifier portion of the circuit has first and second input terminals, with the first input terminal being connected to a voltage reference circuit for providing a substantially constant reference voltage input to the amplifier and the second input terminal being connected to the output of a voltage stabilizing circuit which compensates for changes in power supply voltage applied to the circuit. The differential amplifier circuit also includes first and second output terminals, with the first output terminal being connected to the input of a temperature stabilizing circuit which serves to compensate for changes in circuit component characteristics with temperature variations, while the second differential amplifier output is connected to the input of the voltage stabilizing circuit. Both the voltage and temperature stabilizing circuits operate on a feedback principle, each receiving an input from one of the two differential amplifier output terminals, and each in turn providing a feedback signal back to the differential amplifier to provide the desired stabilization. The circuit output, a constant-current output signal, is generated in an output circuit which is coupled to the first output of the differential amplifier.

By using a differential amplifier configuration, with its double-ended input and output terminals, both voltage and temperature stabilization can be incorporated into the same circuit. In effect, one half of the differential amplifier is coupled to the voltage stabilizing circuit, while the other half is coupled to the temperature stabilizing circuit. The result is a simple and efficient, yet high performance, constant current source circuit which provides both voltage and temperature stabilization. Such a circuit is useful in many applications, particularly in battery-powered equipment where substantial variations in both temperature and operating voltage are likely to occur.

BRIEF DESCRIPTION OF THE DRAWINGS

The single FIGURE is a schematic diagram of a voltage and temperature stabilized constant current source circuit in accordance with a preferred embodiment of the invention.

DETAILED DESCRIPTION

A voltage and temperature stabilized constant current source circuit in accordance with the invention is shown in the single FIGURE of the drawing. A power supply terminal 1 is provided for receiving a power supply voltage $V_{cc}$, while a ground terminal 3 serves as the power supply return and common terminal of the circuit.

The constant current circuit includes a differential amplifier circuit comprising bipolar transistors Q5 and Q6, of like type, with their emitter zones connected together to form a current supply terminal of the amplifier. First and second input terminals of the differential amplifier are formed, respectively, by the base zones of transistors Q6 and Q5, while first and second output terminals of the differential amplifier are formed at the respective collector zones of transistors Q6 and Q5. The current supply terminal at the junction of the emitter zones of transistors Q5 and Q6 is connected to power supply terminal 1 via series-connected resistors R6 and R7.

A voltage reference circuit for providing a reference voltage to the base zone of transistor Q6 comprises a pair of series-connected diodes D1 and D2 connected with like polarity between power supply terminal 1 and the base zone of transistor Q6. In order to ensure proper tracking of the junctions of diodes D1 and D2 with the remaining transistor junctions in the circuit, these diodes are formed by diode-connected transistors, a technique well-known in the art.

The voltage stabilizing circuit, which serves to compensate for changes in power supply voltage, includes a feedback amplifier circuit composed of bipolar transistors Q2 and Q4, of like type. The emitter zone of transistor Q2 is connected to ground terminal 3, while the collector zone of this transistor is connected to the base zone of transistor Q4. A resistor R3 is connected from the base zone of transistor Q2 to the emitter zone of transistor Q4, and a resistor R4 is connected from the emitter zone of transistor Q4 to ground terminal 3. The input signal to the feedback amplifier circuit is taken from the second output terminal of the differential amplifier, at the collector zone of transistor Q5, and is applied to the base zone of transistor Q2, while the output of the feedback amplifier is provided from the collector zone of transistor Q4 back to the second input terminal of the differential amplifier at the base zone of transistor Q5.

Current is supplied to an intermediate current summing node at the junction of the collector zone of transistor Q2 and the base zone of transistor Q4 by a first current source which comprises a reactor R2 connected from the power supply terminal 1 to the emitter zone of a transistor Q1, with the collector zone of transistor Q1 being connected to the current summing node of the feedback amplifier circuit. Additionally, a resistor R1 is connected from the power supply terminal 1 to the current summing node to provide a start-up current, as will be explained more fully below. A second current source, composed of a resistor R5 connected from the power supply terminal 1 to the emitter zone of a bipolar transistor Q3, with the collector zone of transistor Q3 being connected to the second input terminal of the differential amplifier circuit, serves to provide collector current to transistor Q4. The current supplied by the first and second current sources is maintained substantially constant by connecting the base zones of both current source transistors (Q1 and Q3) to the first input terminal of the differential amplifier circuit, as this terminal is maintained at a substantially constant reference voltage via diodes D1 and D2. Current is supplied to diodes D1 and D2 by a third current source composed of a transistor Q8, which has its collector zone connected to diode D2 at the first input terminal of the differential amplifier and its emitter zone connected to ground terminal 3 through a resistor R9. A control signal is applied to the input of the third current source by connecting the intermediate current summing node of the feedback amplifier to the input terminal of the current source at the base zone of transistor Q8.

Changes in circuit component characteristics with temperature are compensated for by a temperature stabilizing circuit composed of a bipolar transistor Q7, of opposite type to that of the differential amplifier transistors Q5 and Q6. Transistor Q7 receives an input signal from the first output of the differential amplifier via a connection from the collector zone of transistor Q6 to the base zone of transistor Q7. A resistor R8 is connected from the base zone of transistor Q7 to ground terminal 3, while the emitter zone of transistor Q7 is connected directly to the ground terminal. Feedback for temperature stabilization is provided by connecting the collector zone of transistor Q7 back to the junction between series-connected resistors R6 and R7 of the differential amplifier circuit.

The output circuit of the constant current source circuit is composed of a bipolar transistor Q9 of the same type as transistor Q7, with its base zone connected to the base zone of transistor Q7, its emitter zone connected to the ground terminal 3 and its collector zone connected to a current output terminal 2 of the constant current source circuit.

The current source circuit of the invention is activated by the application of a voltage $V_{cc}$ to the power supply terminal 1 with respect to the ground terminal 3. Upon the application of this voltage, a starting current flows from the power supply terminal, through resistor R1 and the base-emitter junctions of transistors Q4 and Q8 to ground through their respective emitter resistors R4 and R9. The current flowing through R4 will develop a potential that will provide base drive to transistor Q2 through resistor R3. The activation of transistor Q8 will cause a current to flow through series-connected diodes D1 and D2, thereby establishing a reference voltage at the base zones of transistors Q1, Q3 and Q6. Upon the application of this reference voltage, each of these transistors will provide a substantially constant current output. In the steady state condition, the voltage at the first input terminal of the differential amplifier, at the base zone of transistor Q5, will substantially equal the reference voltage at the base zone of transistor Q6, and a constant current will be generated at the first output terminal of the differential amplifier circuit to drive output transistor Q9.

Operation of the circuit of the present invention for changes in both supply voltage and ambient temperature will now be described. The effect of power supply voltage changes on circuit operation, caused for example by a decrease in supply voltage over time for a battery supply, is attentuated in both the differential amplifier Q5–Q6 and in the feedback amplifier Q2–Q4. Although the current out of the collector zones of transistors Q1 and Q3 will remain substantially constant with changes in power supply voltage, due to the relatively stable reference voltage applied to their base zones as well as degeneration in resistors R2 and R5, a change in the power supply voltage would tend to result in a change in current through start-up resistor R1. Assuming a decreasing power supply voltage, the current through resistor R1 would tend to decrease, thus decreasing the base drive available from this source to transistors Q4 and Q8. However, any decrease in collector current in transistor Q4 will result in an increase in voltage at the collector zone of transistor Q4, thus causing an increase in voltage at the base zone of transistor Q5, the second input terminal of the differential amplifier. This in turn will cause a decrease in the collector current out of transistor Q5, and the combined effect of the decrease in current through transistors Q4 and Q5 will result in a decrease in current supplied to the base zone of transistor Q2. As a result, the collector current in transistor Q2 will decrease, and a larger percentage of the total current flowing into the current summing node of the feedback amplifier will flow instead into the base zones of transistors Q4 and Q8, thus restoring the circuit to its steady-state condition. Similarly, other changes resulting from power supply variations will be likewise compensated for in the negative feedback amplification loop comprising transistors Q2, Q4 and Q5.

Temperature stabilization is enhanced by the fact that the circuit of the present invention has been designed to include as many reciprocal, and thus cancelling, temperature coefficients as possible. For the case of an increase in temperature, for example, the resistance value of the resistors in the circuit will increase, while the diode (base-emitter junction) voltages of the transistors will decrease. However, the circuit has been designed such that many of these temperature coefficients will be reciprocal and thus mutually cancelling. For an increase in temperature, the resistance of resistor R5, for example, will increase while at the same time the base-emitter junction voltage of transistor Q3 will decrease. However, any change in output current provided to the second input terminal of the differential amplifier terminal from the collector zone of transistor Q3 due to these changes will be compensated for by a like change in the current drawn from this terminal by similar changes with temperature in the value of resistor R4 and the base-emitter junction voltage of transistor Q4, thus maintaining the current supplied to transistor Q5 substantially constant. Similarly, changes in the base-emitter junction voltages of transistors Q1 and Q2 with temperature will cancel. At the first input terminal of the differential amplifier, the temperature coefficients of diode D2 and the base-emitter diode junction of transistor Q6 will likewise cancel, but the decreasing voltage across diode D1 combined with the increasing resistance value of resistors R6 and R7 would, if not compensated for, tend to decrease the output current at the collector of transistor Q6. However, with an increase in temperature the value of R8 increases, while the voltage across the base-emitter junctions of transistors Q7 and Q9 decreases. These changes will substantially cancel out the changes in the temperature coefficients of diode D1 and resistors R6 and R7, thus resulting in a substantially constant current at the collector zones of transistors Q7 and Q9. To the extent that temperature stabilization is not perfect, due for example to a mismatch in component temperature coefficients, a further negative feedback loop is provided from the collector zone of transistor Q7 back to the junction between resistors R6 and R7 in the emitter circuit of the differential amplifier. For example, any circuit imbalance tending to increase the differential amplifier output current, at the collector of transistor Q6, would also increase the base drive to transistor Q7, thus causing an increase in collector current in transistor Q7. Since the collector zone of Q7 receives current from emitter resistor R6 of the differential amplifier, any increase in collector current through Q7 will shunt a portion of the current that would otherwise be provided to the differential amplifier to ground, thus tending to cancel out the original increase in output current. The degree of feedback necessary for optimum temperature compensation in this feedback loop can be provided by appropriately selecting the ratio of resistors R6 and R7 while mantaining the value of R6 plus R7 constant.

Thus, by the use of negative feedback loops in both sections of the differential amplifier circuit, as well as by the use of a technique of temperature coefficient cancellation, the present invention provides a constant current source circuit having both voltage and temperature stabilization.

While the invention has been particularly shown and described with reference to a preferred embodiment thereof, it will be understood by those skilled in the art that various changes in form and detail may be made without departing from the spirit and scope of the invention.

I claim:

1. A voltage and temperature stabilized constant current source circuit having power supply and ground terminals, which comprises:

differential amplifier circuit means having first and second input terminals, first and second output terminals and a current supply terminal;

voltage reference circuit means for providing a reference voltage to the first input terminal of said differential amplifier;

voltage stabilizing circuit means for compensating for changes in the voltage applied to said power supply terminal and having an input terminal coupled to said second output terminal of the differential amplifier and an output terminal coupled to said second input terminal of the differential amplifier;

temperature stabilizing circuit means for compensating for changes in circuit component characteristics with temperature variations and having an input terminal coupled to the first output terminal of said differential amplifier and an output terminal coupled to said current supply terminal of the differential amplifier; and output circuit means having an input terminal coupled to said first output terminal of the differential amplifier and an output terminal for providing a stabilized constant current output signal.

2. A stabilized constant current source circuit as in claim 1, wherein said differential amplifier circuit means comprises first and second bipolar transistors of like type, each having base, emitter and collector zones, the emitter zones of said transistors being connected together to form the current supply terminal of said differential amplifier, the base zones of said first and second transistors forming, respectively, the first and second input terminals of said differential amplifier and the collector zones of said first and second transistors forming, respectively, the first and second output terminals of said differential amplifier; and first and second resistors connected in series between said differential amplifier current supply terminal and the circuit power supply terminal.

3. A stabilized constant current source circuit as in claim 2, wherein said voltage reference circuit means comprises a pair of series-connected diodes connected with like polarity between said first input terminal of the differential amplifier and the power supply terminal of the circuit.

4. A stabilized constant current source circuit as in claim 3, wherein said voltage stabilizing circuit means comprises:

feedback amplifier circuit means having an input terminal connected to the second output terminal of the differential amplifier, an output terminal connected to the second input terminal of the differential amplifier, and an intermediate current summing node;

a first current source connected from the power supply terminal of the circuit to said intermediate current summing node and having an input terminal connected to the first input terminal of the differential amplifier;

a second current source connected from the power supply terminal of the circuit to the second input terminal of the differential amplifier and having an input terminal connected to the first input terminal of the differential amplifier; and a third current source connected from the first input terminal of said differential amplifier to the circuit ground terminal and having an input terminal connected to said intermediate current summing node.

5. A stabilized constant current source circuit as in claim 4, wherein said temperature stabilizing circuit means comprises a third bipolar transistor of opposite type to that of said first and second transistors and having base, emitter and collector zones, the base zone of said third transistor being connected to the first output terminal of said differential amplifier, the emitter zone of said third transistor being connected to the circuit ground terminal, and the collector zone of said third transistor being connected to the junction between said first and second series-connected resistors.

6. A stabilized constant current source circuit as in claim 5, wherein said output circuit means comprises a fourth bipolar transistor of like type to that of said third transistor and having base, emitter and collector zones, the base zone of said fourth transistor being connected to the first output terminal of said differential amplifier, the emitter zone of said fourth transistor being connected to the circuit ground terminal, and the collector zone of said fourth transistor forming the constant current source circuit output terminal.

7. A stabilized constant current source circuit as in claim 6, wherein said feedback amplifier circuit means comprises fifth and sixth bipolar transistors, of like type opposite to that of said first and second transistors and each having base, emitter and collector zones, the collector zone of said fifth transistor being connected to the base zone of said sixth transistor to form said intermediate current summing node, the emitter zone of said fifth transistor being connected to said ground terminal, the base zone of said fifth transistor forming the input terminal of said feedback amplifier circuit and the collector zone of said sixth transistor forming the output terminal of said feedback amplifier circuit, said feedback amplifier circuit further comprising a third resistor connected from the base zone of said fifth transistor to the emitter zone of said sixth transistor, a fourth resistor connected from the emitter zone of said sixth transistor to said ground terminal, and a fifth resistor connected from the collector zone of said fifth transistor to the power supply terminal.

8. A stabilized constant current source circuit as in claim 7, wherein said first, second and third current sources each comprise a further bipolar transistor in combination with a series-connected emitter resistor, the input terminal of each said current source being formed at the base zone of its respective transistor.

* * * * *